US010296029B2

(12) United States Patent
Wu

(10) Patent No.: US 10,296,029 B2
(45) Date of Patent: May 21, 2019

(54) METHOD FOR ADAPTIVE COMPENSATION OF LINEAR VOLTAGE REGULATORS

(71) Applicant: pSemi Corporation, San Diego, CA (US)

(72) Inventor: Gary Chunshein Wu, San Diego, CA (US)

(73) Assignee: pSemi Corporation, San Diego, CA (US)

( * ) Notice: Subject to any disclaimer, the term of this patent is extended or adjusted under 35 U.S.C. 154(b) by 0 days.

(21) Appl. No.: 15/882,920

(22) Filed: Jan. 29, 2018

(65) Prior Publication Data

US 2019/0050013 A1 Feb. 14, 2019

Related U.S. Application Data

(63) Continuation of application No. 15/642,204, filed on Jul. 5, 2017, now Pat. No. 9,915,963.

(51) Int. Cl.
*G05F 1/575* (2006.01)

(52) U.S. Cl.
CPC ..... *G05F 1/575* (2013.01)

(58) Field of Classification Search
CPC . G05F 1/575; G05F 1/56; G05F 1/565; G05F 1/468; H02M 3/158
See application file for complete search history.

(56) References Cited

U.S. PATENT DOCUMENTS

| | | | | |
|---|---|---|---|---|
| 5,850,139 | A * | 12/1998 | Edwards | G05F 1/565 323/280 |
| 6,765,374 | B1 | 7/2004 | Yand et al. | |
| 7,719,241 | B2 * | 5/2010 | Dean | G05F 1/46 323/273 |
| 9,915,963 | B1 | 3/2018 | Wu | |
| 9,998,075 | B1 | 6/2018 | Adamski | |
| 2006/0132107 | A1 | 6/2006 | Sicard | |
| 2008/0203983 | A1 * | 8/2008 | Lo Lacono | G05F 1/565 323/266 |
| 2012/0326768 | A1 | 12/2012 | Bhattacharya et al. | |
| 2017/0160757 | A1 | 6/2017 | Yang | |
| 2018/0284829 | A1 * | 10/2018 | Hussien | G05F 1/63 |

OTHER PUBLICATIONS

Pham, Emily P., Notice of Allowance received from the USPTO dated Jan. 16, 2018 for U.S. Appl. No. 15/642,204, 14 pgs.

* cited by examiner

*Primary Examiner* — Emily P Pham
(74) *Attorney, Agent, or Firm* — Jaquez Land Greenhaus LLP; Martin J. Jaquez, Esq.; Alessandro Steinfl, Esq.

(57) ABSTRACT

Devices and methods to design voltage regulators requiring lower power consumption, wide output current and input voltage range, low dropout, and small footprint. The disclosed methods and devices provide solutions to stabilize such regulators in the presence of widely varying loads by tracking a pole of the transfer function, the pole of the transfer function corresponding to a combination of the load capacitance and the load resistance.

20 Claims, 8 Drawing Sheets

600A

600B

| Conditions: 12V input, 5V output, 55C | | | |
|---|---|---|---|
| iload | cload | Phase Margin w/o adaptive zero (degrees) | Phase Margin w/ adaptive zero (degrees) |
| 1 uA | 22 uF | 89.4 | 89.4 |
| 1 uA | 2.2 uF | 84.4 | 84.5 |
| 10 uA | 2.2 uF | 69 | 70.4 |
| 100 uA | 2.2 uF | 51.6 | 70.1 |
| 1 mA | 2.2 uF | 33.6 | 73.2 |
| 10 mA | 2.2 uF | 40.4 | 72 |
| 100 mA | 2.2 uF | 53.08 | 53.1 |

600C

FIG. 6C

METHOD FOR ADAPTIVE COMPENSATION OF LINEAR VOLTAGE REGULATORS

CROSS-REFERENCE TO RELATED APPLICATIONS—CLAIM OF PRIORITY

This application is a continuation of, and claims the benefit of priority under 35 U.S.C. § 120 of, commonly assigned and co-pending prior U.S. application Ser. No. 15/642,204, filed Jul. 5, 2017, "Method for Adaptive Compensation of Linear Voltage Regulators", the disclosure of which is incorporated herein by reference in its entirety. Application Ser. No. 15/642,204 is related to U.S. Ser. No. 15/415,768 filed Jan. 25, 2017, entitled "LDO with Fast Recovery from Saturation", incorporated herein by reference in its entirety.

BACKGROUND

(1) Technical Field

The present disclosure is related to linear voltage regulators, and more particularly to methods and apparatus for adaptive stabilization of linear voltage regulators.

(2) Background

A voltage regulator is generally defined as a device designed and used to maintain a steady voltage. There are generally two main types of regulators, linear and switching regulators. Two different types of linear regulators are generally known: standard regulators and low dropout regulators (LDOs). An LDO differs from a standard voltage regulator in that the LDO can operate with a very small voltage difference between the regulated output voltage level and the unregulated input voltage. Regardless of their type, voltage regulators are mostly designed to meet stringent and often conflicting requirements dictated by demanding applications. Examples of such requirements and corresponding definitions are as follows:

- Large output current range varying from few uA to few hundreds of mA, although there are LDOs that can support tens of amperes of current.
- Low operating current. This current does not include load current and is essentially the current flowing through the regulator in the absence of a load. Depending on the application, operating currents smaller than 5 uA may be required. A lower operating current will result in a lower power consumption which is highly desired by most electronics applications.
- Small output capacitor physical dimension to minimize printed circuit board (PCB) footprint.
- Low dropout voltage. This refers to the smallest difference between input and output voltages required to maintain regulation. This means, an LDO can hold the output load voltage constant as the input is decreased until the input reaches the output voltage plus the dropout voltage, at which point the output "drops out" of regulation. The dropout voltage should be as low as possible to minimize power dissipation, a typical example could be as low as less than 0.3V.
- High input voltage range. A typical range could be anywhere from 5V to 20V. (While a typical range maybe 5V to 20V, 3V to hundreds of volts are also available in the market.)

As known to the person skilled in art, designing for a combination of stringent and conflicting requirements such as low power consumption, wide output current and input voltage range, low dropout and small footprint is a difficult and challenging task. As an example, a small footprint requirement will limit the voltage rating, size and therefore the maximum output capacitor value that can be used. Depending on the application, a typical example could be a 10V rating 0402 size (dimension of the capacitor, 40 mils by 20 mils where 1 mil is 1/1000 inch) with a temperature rating of 125° C. implying an allowed maximum capacitor of only less than 2.2 uF. It is known to the person skilled in art that such limitation may result in a significant challenge on stabilizing the regulated voltage in demanding applications with additional stringent requirements as described above.

FIG. 1 shows a typical LDO 100 comprising an operational amplifier (OA) 101 having a first input 104, a second input 103 and an OA output 102. The LDO 100 further comprises a PMOS transistor MP1 via which an output current is delivered. A gate voltage of the transistor MP1 is controlled by the OA 101 via the OA output 102. A reference voltage Vref and a feedback voltage Vf are received respectively by the OA inputs 104 and 103. Such voltages are compared and their difference is amplified so as to reduce an error voltage representing the difference between Vref and the feedback voltage Vf. The LDO 100 is configured to receive an input voltage Vin at input terminal 115 and to output a regulated voltage output Vout at an output terminal 116. The LDO 100 further comprises a feedback circuit 110 comprising resistors R1 and R2, the resistors R1 and R2 being arranged as a voltage divider. The feedback voltage Vf is the voltage appearing across the resistor R2 which is therefore a function of the output voltage Vout. A typical value for the reference voltage Vref is 1.2V. If the feedback voltage Vf is lower than the reference voltage Vref, a gate of the transistor MP1 is pulled lower, allowing more current to pass and increasing the output voltage Voutput. If the feedback voltage Vf is higher than the reference voltage Vref, the gate of the transistor MP1 is pulled higher, restricting the current flow and decreasing the output voltage Vout. A capacitor CL and a resistor RL represent respectively a load capacitance and a load resistance. The LDO 100 further comprises a feed-forward capacitor CFF coupled across the resistor R1.

Referring to FIG. 1, the LDO 100 represents essentially a closed-loop system, the dynamic of which depends on the location of the system poles and zeros which are described in below:

$$p1 \text{ (load pole)}: \frac{1}{2\pi R_{out} C_{out}},$$

where $R_{out}$ is the parallel combination of $R_L$, $R_{on}$ (on resistance of the transistor MP1 and $R_1+R_2$ (in series)

$$p2 \text{ (power pole)}: \frac{1}{2\pi R_{o_OA} C_{gate_PMOS}},$$

where $R_{o_OA}$ is the output impedance of the OA and $C_{gate_PMOS}$ is the gate capacitance of the transistor MP1

$$p3 \text{ (feed-forward pole)}: \frac{1}{2\pi R_1 \| R_2 C_{FF}}$$

-continued $$z1 \text{ (effective series resistance } (ESR) \text{ of } CL): \frac{1}{2\pi ESR\ C_L}, \text{ and}$$

$$z2 \text{ (feed-forward) zero}: \frac{1}{2\pi\ R_1 C_{FF}}$$

FIG. 2 shows an example of such poles and zeros and their relative locations on a frequency axis for typical applications with stringent requirements as explained previously. It is well known that in a closed-loop system and from a stability stand point, it is highly desired to have one dominant pole and to have other poles and zeros further out towards higher frequencies. In other words and with reference to FIG. 2, an ideal situation implying a more stable system would have been to have the pole p1 as the dominant pole corresponding to a much lower frequency than what p2, p3, z1 and z2 would correspond to. However and as shown in equations above, p1 depends on the load condition which is widely varying in typical applications. This variation is also represented by an arrow 240 shown in FIG. 2. In other words, regulators are designed to work with various circuits representing widely different loads and/or with one circuit showing different load conditions (off, on, low power, high power etc.). It is understood that an output current variation of few uA to few hundreds of mA will result in at least 6 decades of variations for the pole p1.

FIG. 2 also shows an arrow 230 representing variations of the pole p2 which has, in typical applications, a much smaller range compared to the range of variations of the pole p1, shown by an arrow 240. In operative conditions, as the output current changes, the transistor MP1 capacitance changes accordingly and this result in such variations of p2 as mentioned above. The person skilled in art will understand that, with the poles p1 and p2 being in vicinity of each other and given the wide variations of p1 as a function of different load conditions, the task of stabilizing such a closed-loop system is a challenging one. It is also noted that, the zeros z1 and z2 are relatively fixed with almost negligible variations compared to those of the poles p and p2. This also adds to the challenge of loop stabilization. One possible solution to overcome such stability issue is to make the pole p1 dominant by using a larger output capacitor. In most applications, this solution is not acceptable given stringent footprint requirements prohibiting the use of such large capacitors. Another possible solution would be to push the pole p2 further out towards much higher frequencies. With reference to the equation describing p2 above, this would imply a smaller output resistance of the OA 101 previously shown in FIG. 1, which in turn means a larger current flow through said OA. This solution won't be acceptable in most practical situations wherein a stringent power consumption requirement is imposed. One further possible solution to address the stability issue may be to add Miller compensation to MP1 or within OA 101 to provide a dominant pole which is again impractical given strict on-chip area requirements in most applications implementing linear regulators. Yet another solution is to have a class AB op-amp or else using means to boost the current in the op-amp as needed and as disclosed in U.S. Ser. No. 15/415,768 incorporated herein by reference in its entirety.

SUMMARY

Reiterating what was described above, design of voltage regulators is challenging due to stringent and usually conflicting requirements such as the ones described above. Methods and devices taught in the present disclosure provide design solutions for applications requiring low power consumption, wide output current and input voltage range, low dropout, and small footprint. More in particular, the disclosed methods and devices provide solutions to achieve highly stabilized output while meeting such stringent requirements.

According to a first aspect of the present disclosure, a low drop out voltage regulator (LDO) configured to receive an input voltage at an input terminal and to output a output voltage to an output terminal is provided, comprising: (i) a feedback circuit configured to generate a feedback voltage as a function of the output voltage; (ii) an operational amplifier configured to receive a reference voltage and the feedback voltage, and to generate an error signal based on a combination of the feedback voltage and the reference voltage; (iii) a first transistor configured to receive the error signal and to generate a corresponding load current; and (iv) a tracking circuit; wherein: (a) the output terminal is connectable to a load, the load comprising a load resistance and a load capacitance; (b) a ratio of the regulated output voltage to the input voltage has a transfer function comprising a load pole and a zero, wherein: (b1) the load pole is a function of a combination of the load resistance and the load capacitance; and (b2) the zero is a function of the load capacitance and an equivalent series resistance of the load capacitance; and (c) the tracking circuit is configured to adjust the zero to track movements of the load pole due to variations of the load current.

According to a second aspect of the present disclosure, a voltage tracking circuit is provided, comprising: a first transistor and a second transistor; a first electronic block comprising a series arrangement of a first resistor and a third transistor; a second electronic block comprising a series arrangement of a second resistor with a fourth transistor; and a current mirror connected with the first electronic block and the second electronic block; wherein: the first electronic block is coupled across a gate-source of the first transistor; the second electronic block is coupled across a gate-source of the second transistor; the first electronic block is configured to generate a first current as a function of a gate-source voltage of the first transistor; the current mirror is configured to receive the first current, to mirror the first current to a second current and to flow the second current through the second electric block, thereby generating a voltage across a gate-source of the second transistor, the voltage being proportional to the gate-source voltage of the first transistor.

According to a third aspect of the present disclosure, a method of stabilizing a feedback loop in a low dropout voltage regulator (LDO) is disclosed, providing: providing an input voltage to the LDO; providing a load comprising a parallel arrangement of a load capacitance and a load resistance; generating an output voltage and a load current; generating a feedback loop having a transfer function, comprising the steps of: (i) generating a feedback voltage as a function of the output voltage; (ii) adjusting the load current based on a comparison of the feedback voltage and a reference voltage, thereby regulating the output voltage; providing a variable resistor in series with an equivalent series resistance of the load capacitance; thereby: generating a zero of the transfer function, the zero of the transfer function corresponding to a combination of the variable resistor and the load capacitance, the zero of the transfer function varying with the load current, thereby: tracking a pole of the transfer function, the pole of the transfer function corresponding to a combination of the load capacitance and the load resistance.

DESCRIPTION OF THE DRAWINGS

FIG. 6C shows a table capturing some simulation conditions and associated results.

DETAILED DESCRIPTION

The term "triode region" is referred herewith to an operational region wherein a MOSFET operates like a resistor, controlled by the gate voltage relative to source voltage. The term "ON resistance" of a transistor is referred herewith to a drain-source resistance of a MOSFET.

Figure 2:
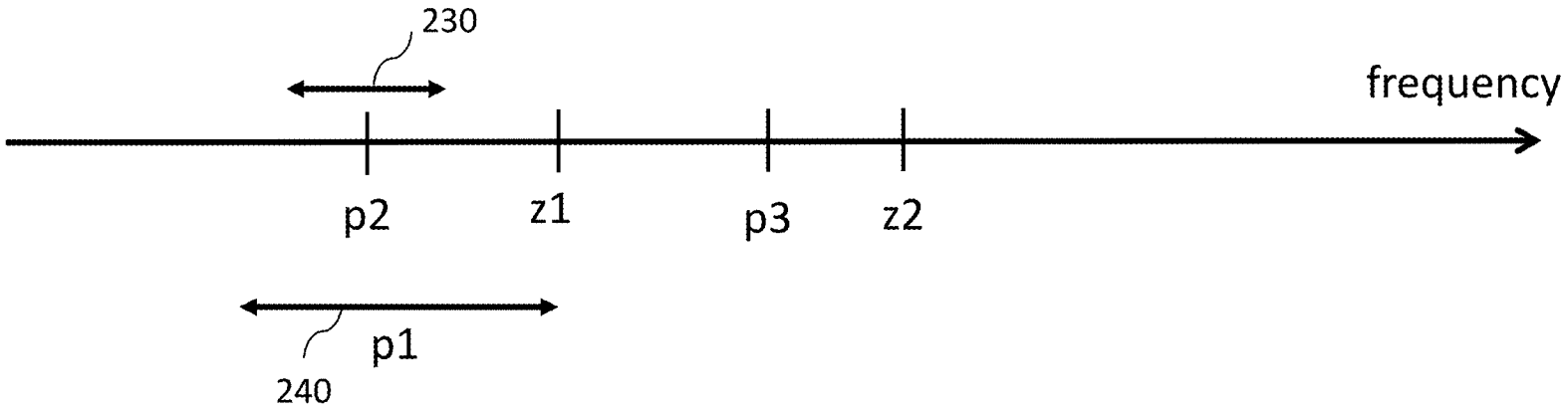
FIG. 2 (PRIOR ART)
FIG. 2 shows an example of relative poles and zeros locations for the LDO of FIG. 1.

Referring back to FIG. 2, and in accordance with embodiments of the present disclosure, one way to overcome the stability issue is to allow the zero z1 to track the load pole p1 movements. This would allow preserving the stability while avoiding prohibitive solutions such as using a large output capacitor. Examples of such embodiments are given below.

Figure 1:
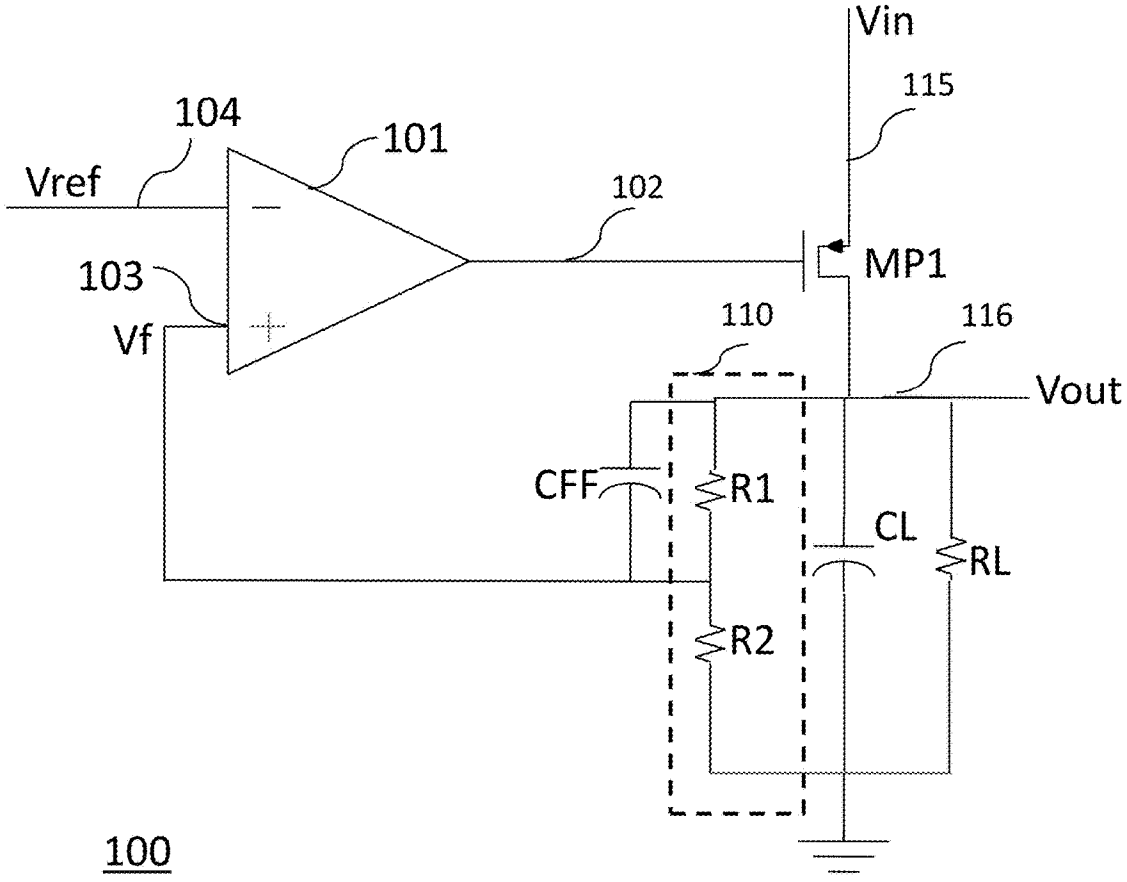
FIG. 1 (PRIOR ART)
FIG. 1 shows a typical architecture of an LDO.
Figure 3:
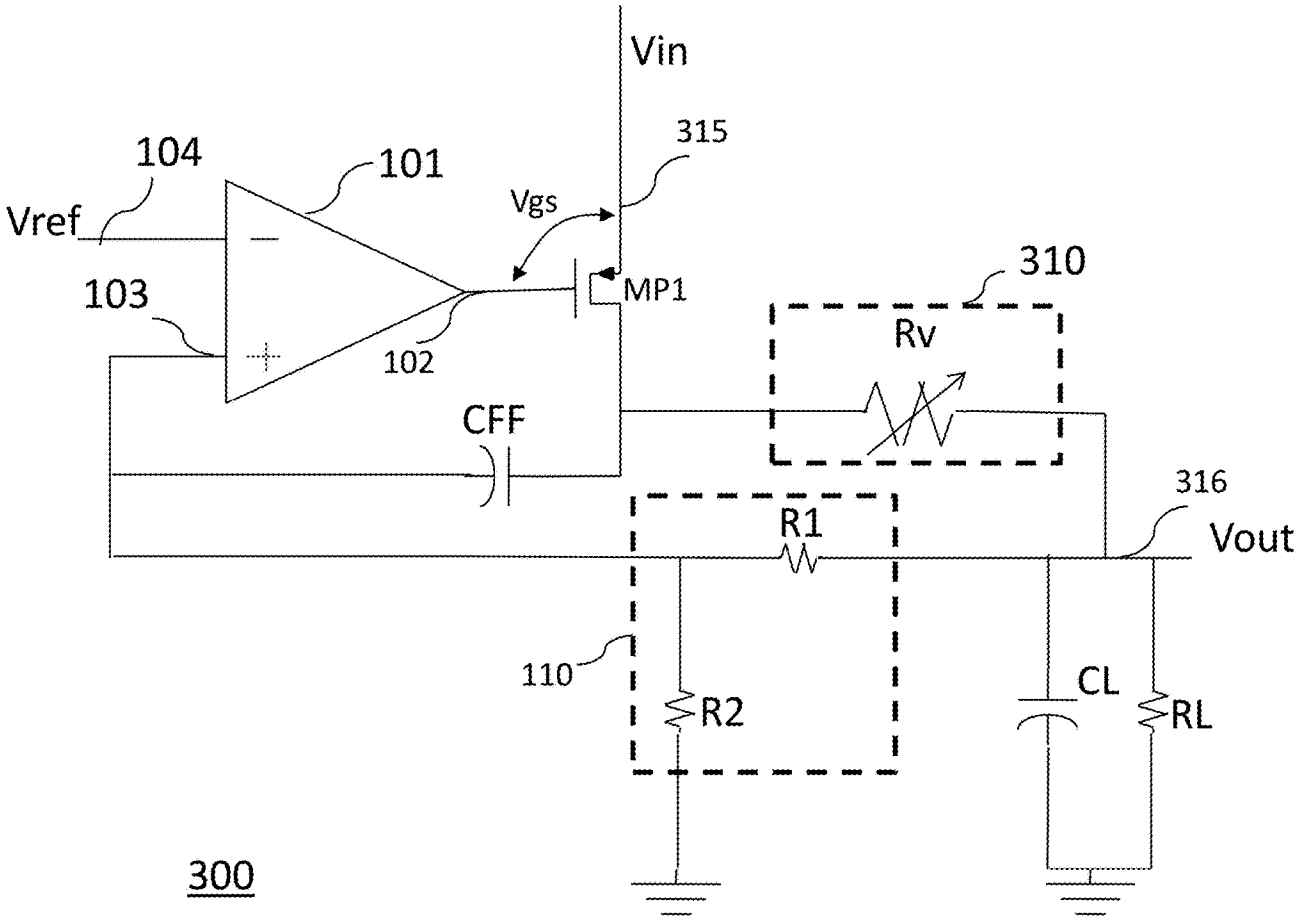
FIG. 3 shows an LDO according to an embodiment of the present disclosure.

FIG. 3 shows an LDO 300 according to an embodiment of the present disclosure. The principle of operation of the LDO 300 is similar to what was described with regards to LDO 100 of FIG. 1. The main difference is that the LDO 300 further comprises a tracking circuit 310, the tracking circuit 310 comprising a variable resistor Rv, arranged in series with the ESR of the capacitor CL. In other words, z1 is now calculated according to $$z1 = \frac{1}{2\pi(ESR + Rv)C_L}.$$

In normal operative conditions where the output voltage Vout is regulated, if the load current is high (smaller RL) the pole p1 will move out to higher frequencies and when the load current is small (larger RL) the pole p will move in to smaller frequencies. It is known to the person skilled in the art that increasing a gate-source voltage Vgs of the transistor MP1 will increase the load current. According to an embodiment of the disclosure, the variable resistor Rv is a voltage dependent resistor having a resistance that is a decreasing function of the voltage Vgs. In other words, and similar to the p movements with the load current, higher load currents will result in smaller Rv resistance values resulting in a movement of z1 to higher frequencies and therefore tracking p movements towards such frequencies. In the case of smaller current and in the same way, z1 will track movements of p1 towards smaller frequencies. The person skilled in the art will appreciate that while adding the variable resistor Rv provides a solution to the stability issues as previously described, potential adverse effects due to adding such series resistance to the output of the LDO 300 are minimized by virtue of such series resistance being essentially a decreasing function of the load current.

Figure 4:
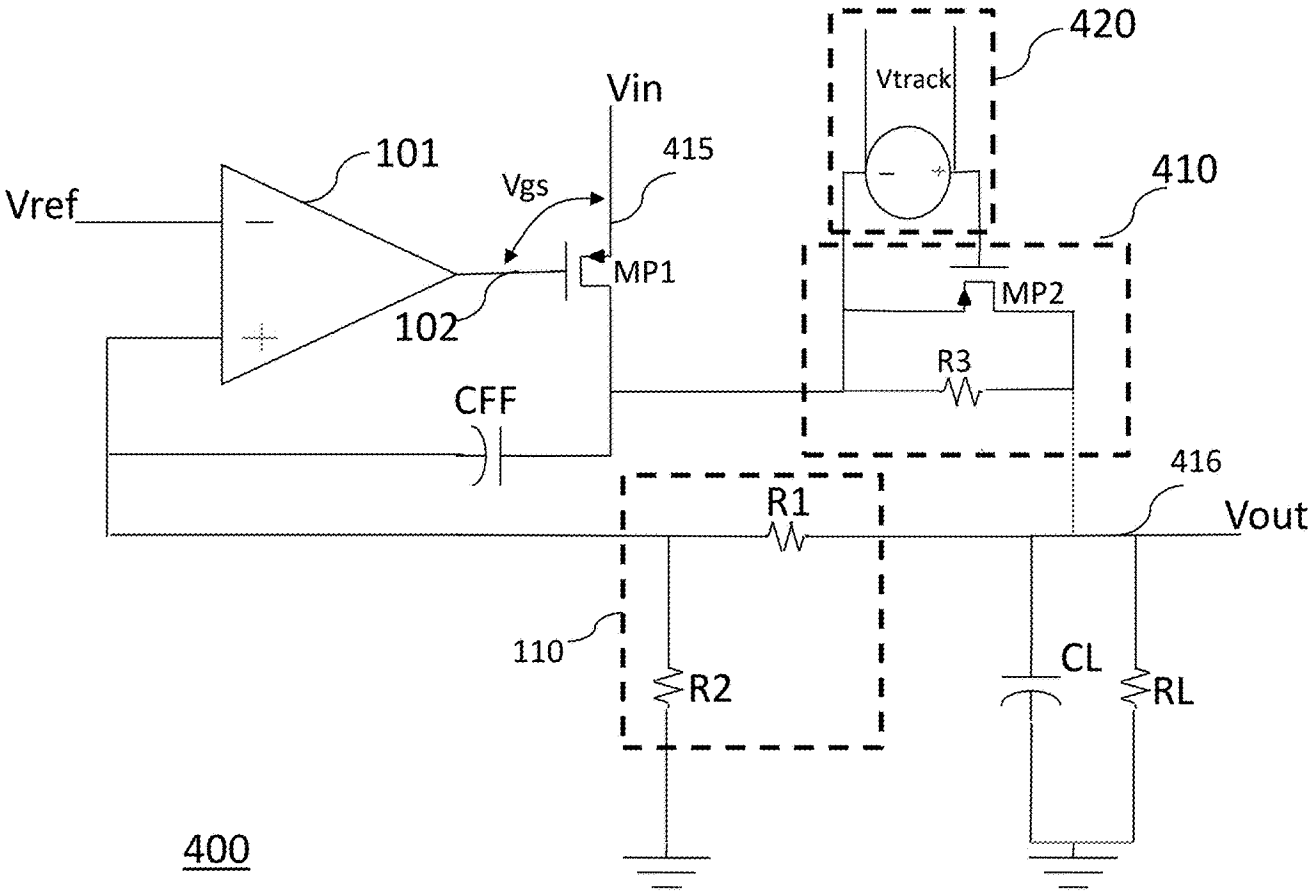
FIG. 4 shows an LDO in accordance with a further embodiment of the disclosure.

FIG. 4 shows an LDO 400 in accordance with a further embodiment of the present disclosure. The principle of operation of the LDO 400 is similar to what was described with regards to LDO 300 of FIG. 3. The LDO 400 comprises a tracking circuit 410, the tracking circuit 410 comprising a PMOS transistor MP2 and a resistor R3 coupled across a drain and source of the transistor MP2. A gate-source voltage of the transistor MP1 is represented by a voltage Vgs. The LDO 400 further comprises a voltage tracking circuit 420 applying a voltage Vtrack across a gate-source of the transistor MP2. In operative conditions, the voltage tracking circuit 420 is configured to track variations of the voltage Vgs and to generate, as a result, the voltage Vtrack which can be equal or proportional to the gate-source voltage Vgs of the transistor MP1. In other words, and as described later in this paper, according to further embodiments of the present disclosure, the voltage Vgs is sensed and a voltage equal or proportional to the sensed Vgs is then generated and applied to the gate-source of the transistor MP2. The transistor MP2 is configured to operate in triode region. This is done my making the transistor MP2 larger than the transistor MP1 and also by including the parallel resistance effect of the resistor R3. As such, and as a result of tracking the voltage Vgs as described, the ON resistance Ron2 of the transistor MP2 will also change according to current load variation. In other words, the ON resistance Ron2 functions as a voltage dependent resistor (depending on the voltage Vgs): at higher/smaller load current, the voltage Vgs is large/small resulting in a small/large Ron2. The person skilled in art will appreciate that the functionality of the ON resistance Ron2 of the transistor MP2, more in particular its dependency on the voltage Vgs (and therefore on the load current), is similar to what was described with regards to the resistor Rv of FIG. 3.

Referring back to FIG. 4, in accordance with an embodiment of the disclosure, the resistor R3 may be implemented using a PMOS transistor MP3 (not shown in FIG. 4). According to a further embodiment of the disclosure, the transistor MP3 is a smaller device than the transistor MP2 and therefore it has a larger ON resistance. The transistor MP3 is configured to be always ON with a fixed ON resistance and its main function is to set the maximum ON resistance of the parallel combination of the transistor MP2 and MP3. As mentioned previously, at higher loads the voltage Vgs is large and therefore the ON resistance Ron2 is small, meaning that the equivalent resistance of the parallel combination of the transistors MP2 and MP3 is mainly set by MP2. On the other hand, at very small to near no load conditions, the maximum resistance of the parallel combination of the transistor MP2 and MP3 is set by MP3 as in such condition, the ON resistance Ron2 of the transistor MP2 could be much larger than that of the transistor MP3. The person skilled in art will understand that, without departing from the scope of the disclosure, other embodiments may be envisaged wherein neither a fixed resistance nor the transistor MP3 is used in parallel with the transistor MP2.

With further reference to FIG. 4, for larger input voltages, and according to an embodiment of the disclosure, a high-voltage PMOS such as double-diffused metal-oxide-semiconductor (DMOS) can be chosen for the transistor MP1 so that a larger drain-to-source voltage drop can be handled. Further embodiments in case of large input voltages can be made, wherein the transistor MP1 is a PMOS and wherein additional cascode PMOS transistors may be implemented in series and below the transistor MP1 wherein, gate bias voltages of the cascode transistors can be generated from a bias circuit. According to other embodiments of the disclosure, the bias circuit can be separate from the OA (101) or included as part of the OA (101) design.

Figure 5:
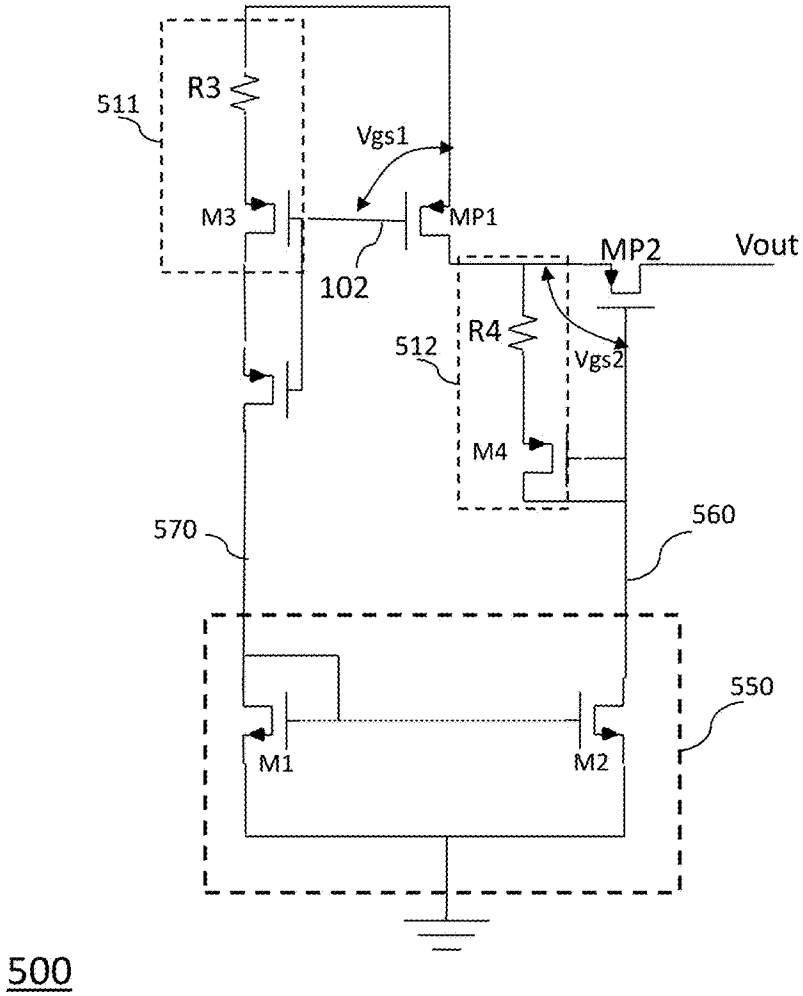
FIG. 5 shows a voltage tracking circuit according to an embodiment of the present disclosure.

FIG. 5 shows a voltage tracking circuit 500 in accordance with an embodiment of the disclosure. The voltage tracking circuit 500 comprises a first electronic block 511 and a second electronic block 512. The first electronic block comprises a transistor M3 arranged in series with a resistor R3. The second electronic block 512 comprises a series arrangement of transistor M4 and a resistor R4. The voltage tracking circuit 500 further comprises transistors M1 and M2 configured as a current mirror. According to an embodiment of the present disclosure, a gate voltage of the transistor MP1 is provided by the OA 101 of FIG. 4. A certain voltage Vgs1 across a gate-source of the transistor MP1 corresponds to a first current generated in a left branch 570, said first current being mirrored to a second current flowing in a right branch 560 and through the electronics block 512. As a result, a voltage Vgs2, equal or proportional to the voltage Vgs1, depending on the ratio of the devices in the left branch 570 to the devices in the right branch 560 (R3 to R4, M3 to M4, and M1 to M2), appears across a gate-source of the transistor MP2. In a similar manner, variations of the voltage Vgs across the gate-source the transistor MP1 are also tracked and proportionally replicated across the gate-source of the transistor MP2. According to an embodiment of the present disclosure, the electronic blocks 511 and 512 are replicated versions of each other, i.e. the resistors R3 and R4 are the same, the transistors M3 and M4 are the same, and the transistor M2 has a larger size than the transistor M1. In such an embodiment and by virtue of the same mechanism described above, the gate-source voltage Vgs and related variations are tracked and replicated across a gate-source of the transistor MP2. The value of R3 and R4 can be selected to set the maximum current consumption of circuit 500. If transistors M3 and M4 are small enough, R3 and R4 can even be omitted. According to an embodiment of the present disclosure, the voltage tracking circuit 500 of FIG. 5 can be used as part of the LDO 400 of FIG. 4 and for voltage tracking purpose. In this case, gates of the transistors M3 and MP1 are connected with and fed by the OA output 102 of the OA 101.

Figure 6A:
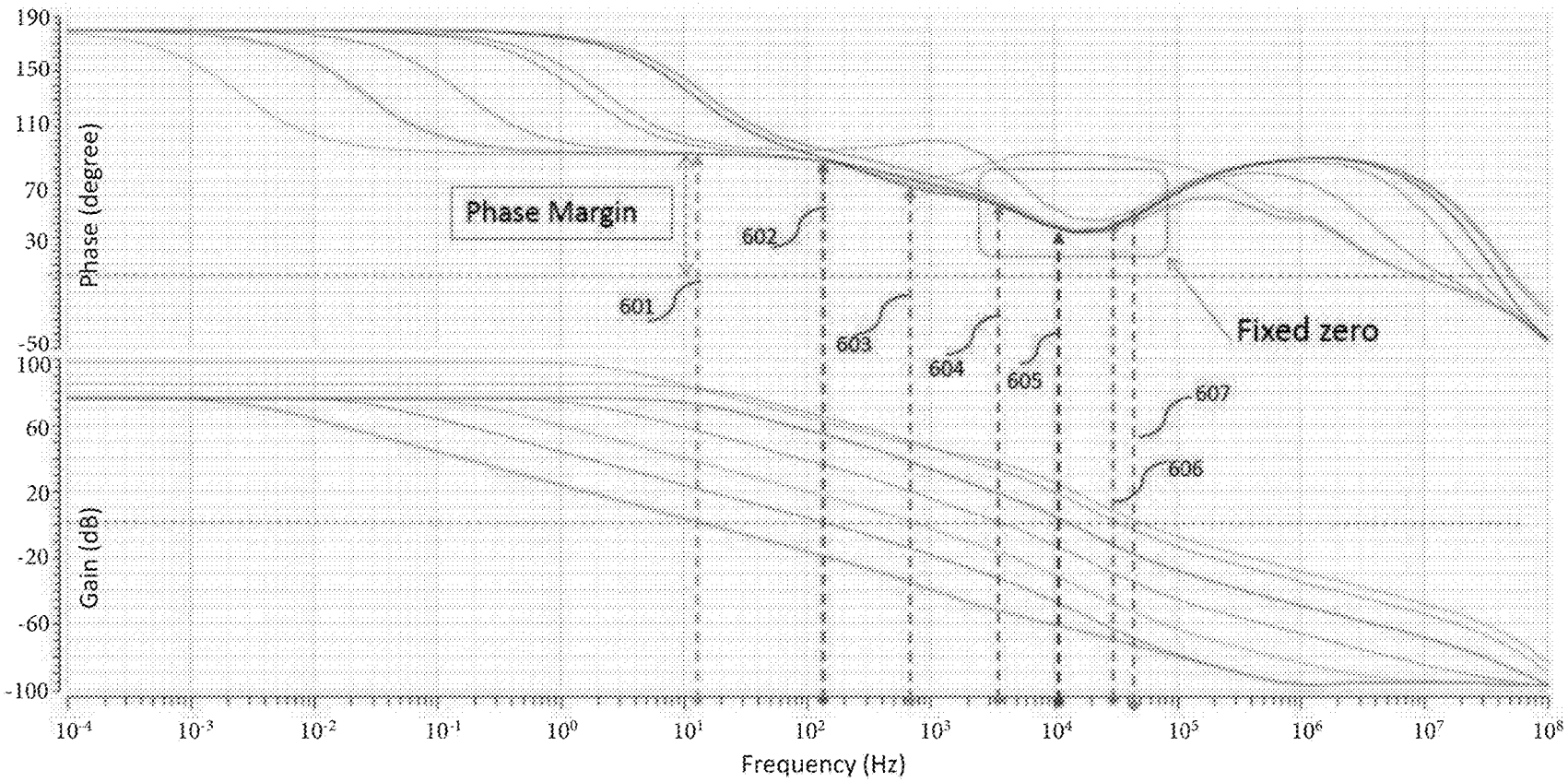
FIG. 6A shows series of Bode plots representing stability conditions of an embodiment of the present disclosure with a fixed series resistance.
Figure 6B:
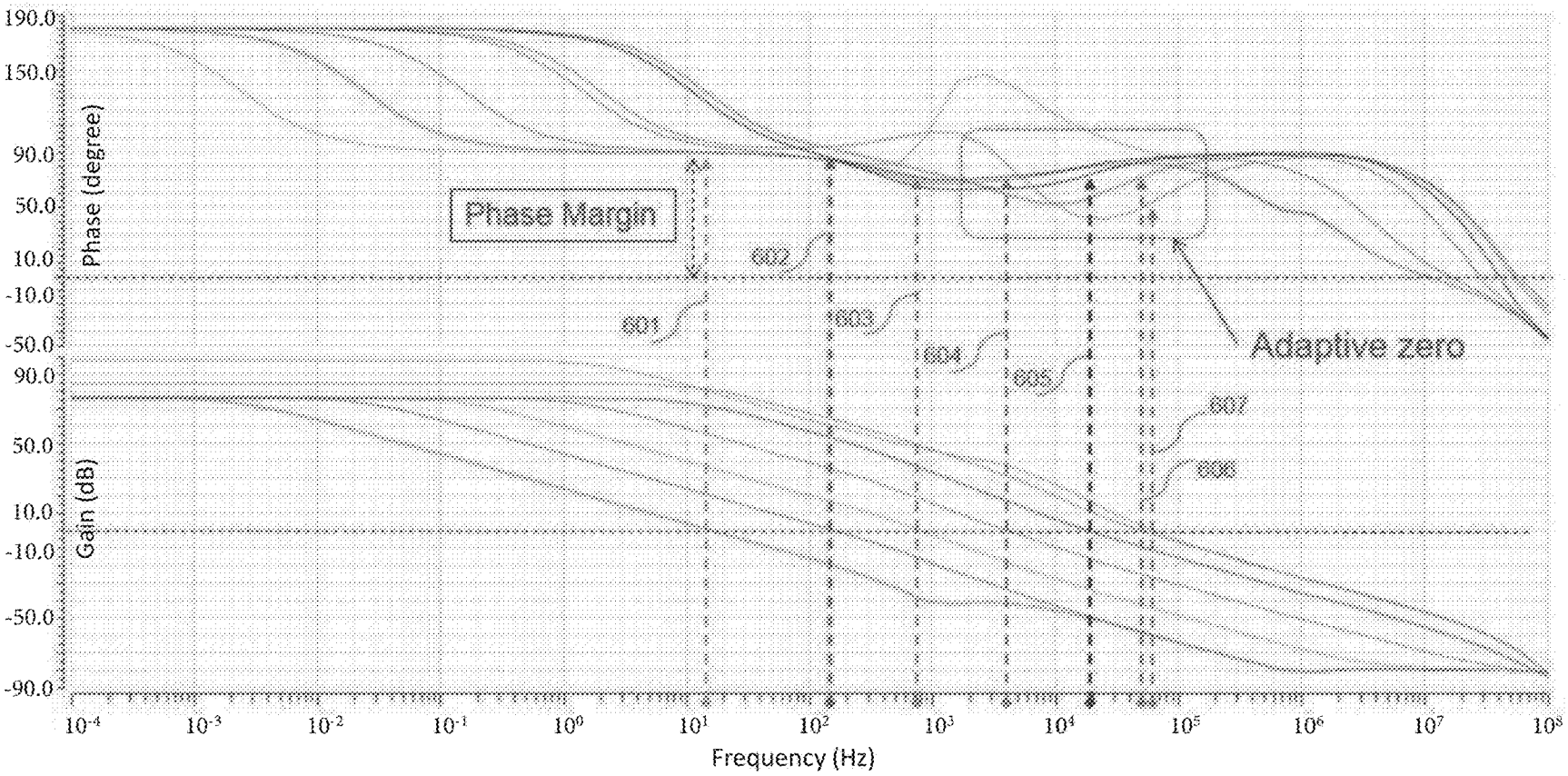
FIG. 6B shows series of Bode plots representing stability conditions of an embodiment of the present disclosure with a variable series resistance.

FIG. 6A-6B shows series of Bode plots representing stability conditions of some exemplary embodiments in accordance with the present disclosure. The plots on top and bottom show loop phase in degrees and gain in decibel (dB) respectively (e.g. phase and gain). The x-axis represent frequency in Hz. Arrows (601, 602, . . . , and 607) are used to show phase margins corresponding to (1 uA, 10 uA, 100 uA, . . . , and 100 mA) load currents respectively. FIG. 6C shows a table 600C wherein the simulation conditions in terms of input voltage, output voltage temperature, load current, and load capacitance values are captured. FIG. 6A represents a reference case where the zero z1 is fixed. This is to be compared with a case shown in FIG. 6B, wherein the zero z1 is adaptively tracking the load pole p1 in accordance with the teachings of the present disclosure. Based on such comparison and referring also to the table 600C of FIG. 6C, improved loop stability is achieved (e.g. larger phase margin) in the case shown in FIG. 6B (adaptive z1) in 100 uA to 10 mA load current range (e.g. arrows 604, 605, and 606). In an embodiment in accordance with the present disclosure, at a required maximum current of 100 mA, there is a maximum tolerable series resistance that limits a lower bound of the zero z1 due to a maximum drop-out voltage requirement. With further reference to the table 600C of FIG. 6C, for a load current of 100 mA, both the adaptive and fixed zero cases have very similar Bode plots showing same phase margins. With reference to FIGS. 6A-6B, the described simulations have been run for load pole frequency steps of one decade and for one operating condition as shown in table 600C of FIG. 6C. Further simulations across more conditions such as process corners and finer load pole frequency steps have been implemented and similar results (e.g. phase margin improvements) have been observed.

The term "MOSFET", as used in this disclosure, means any field effect transistor (FET) with an insulated gate and comprising a metal or metal-like, insulator, and semiconductor structure. The terms "metal" or "metal-like" include at least one electrically conductive material (such as aluminum, copper, or other metal, or highly doped polysilicon, graphene, or other electrical conductor), "insulator" includes at least one insulating material (such as silicon oxide or other dielectric material), and "semiconductor" includes at least one semiconductor material.

As should be readily apparent to one of ordinary skill in the art, various embodiments of the invention can be implemented to meet a wide variety of specifications. Unless otherwise noted above, selection of suitable component values is a matter of design choice and various embodiments of the invention may be implemented in any suitable IC technology (including but not limited to MOSFET structures), or in hybrid or discrete circuit forms. Integrated circuit embodiments may be fabricated using any suitable substrates and processes, including but not limited to standard bulk silicon, silicon-on-insulator (SOI), and silicon-on-sapphire (SOS). Unless otherwise noted above, the invention may be implemented in other transistor technologies such as bipolar, GaAs HBT, GaN HEMT, GaAs pHEMT, and MESFET technologies. However, the inventive concepts described above are particularly useful with an SOI-based fabrication process (including SOS), and with fabrication processes having similar characteristics. Fabrication in CMOS on SOI or SOS processes enables circuits with low power consumption, the ability to withstand high power signals during operation due to FET stacking, good linearity, and high frequency operation (i.e., radio frequencies up to and exceeding 50 GHz). Monolithic IC implementation is particularly useful since parasitic capacitances generally can be kept low (or at a minimum, kept uniform across all units, permitting them to be compensated) by careful design.

Voltage levels may be adjusted or voltage and/or logic signal polarities reversed depending on a particular specification and/or implementing technology (e.g., NMOS, PMOS, or CMOS, and enhancement mode or depletion mode transistor devices). Component voltage, current, and power handling capabilities may be adapted as needed, for example, by adjusting device sizes, serially "stacking" components (particularly FETs) to withstand greater voltages, and/or using multiple components in parallel to handle greater currents. Additional circuit components may be added to enhance the capabilities of the disclosed circuits and/or to provide additional functional without significantly altering the functionality of the disclosed circuits.

A number of embodiments of the invention have been described. It is to be understood that various modifications may be made without departing from the spirit and scope of the invention. For example, some of the steps described above may be order independent, and thus can be performed in an order different from that described. Further, some of the steps described above may be optional. Various activities described with respect to the methods identified above can be executed in repetitive, serial, or parallel fashion.

It is to be understood that the foregoing description is intended to illustrate and not to limit the scope of the invention, which is defined by the scope of the following claims, and that other embodiments are within the scope of the claims. (Note that the parenthetical labels for claim elements are for ease of referring to such elements, and do not in themselves indicate a particular required ordering or enumeration of elements; further, such labels may be reused in dependent claims as references to additional elements without being regarded as starting a conflicting labeling sequence).

What is claimed is:

1. A low drop out voltage regulator (LDO) configured to receive an input voltage at an input terminal and to output an output voltage to an output terminal connectable to a load, comprising:

(i) a feedback circuit configured to generate a load current as a function of the output voltage; and (ii) a tracking circuit;

wherein:

(a) a ratio of the output voltage to the input voltage has a transfer function comprising a load pole and a zero; and (b) the tracking circuit is configured to adjust the zero to track movements of the load pole due to variations of the load current.

2. The LDO of claim 1, wherein the load comprises a load resistance and a load capacitance and wherein the load pole is a function of a combination of the load resistance and the load capacitance.

3. The LDO of claim 2, wherein the zero is a function of the load capacitance and an equivalent series resistance of the load capacitance.

4. The LDO of claim 3, wherein the feedback circuit comprises:

an operational amplifier configured to receive a reference voltage and a feedback voltage proportional to the output voltage, and to generate an error signal based on a combination of the feedback voltage and the reference voltage; and a first transistor configured to receive the error signal and generate a corresponding load current.

5. The LDO of claim 4, wherein the tracking circuit comprises a current-dependent resistor with a resistance being a decreasing function of the load current.

6. The LDO of claim 4, wherein the first transistor is a first PMOS transistor.

7. The LDO of claim 6 wherein the tracking circuit comprises a voltage-dependent resistor with a resistance being a decreasing function of a gate-source voltage of the first PMOS transistor.

8. The LDO of claim 7, wherein:

the feedback circuit comprises two feedback resistors arranged as a voltage divider;

the feedback voltage is a voltage of a point of connection of the two feedback resistors;

the voltage-dependent resistor connects the output terminal to a drain of the first PMOS transistor; and the input terminal is connected with a source of the first PMOS transistor.

9. The LDO of claim 8, further comprising a feed-forward capacitor connecting a drain of the first PMOS transistor with the feedback circuit.

10. The LDO of claim 6, further comprising a voltage tracking circuit and wherein:

the tracking circuit comprises a second PMOS transistor;

the voltage tracking circuit is configured to generate a tracking voltage proportional to a gate-source voltage of the first PMOS transistor; and a gate-source junction of the second PMOS transistor is configured to receive the tracking voltage.

11. The LDO of claim 10, further comprising a fixed resistor coupled across a drain-source of the second PMOS transistor.

12. The LDO of claim 10, further comprising a resistor coupling across a source and drain of the second PMOS transistor.

13. The LDO of claim 12, wherein the resistor comprises a third PMOS transistor.

14. The LDO of claim 13, wherein the third PMOS transistor has a smaller size than the second PMOS transistor.

15. The LDO of claim 4, wherein the zero is further a function of the feedback circuit and an ON resistance of the transistor.

16. The LDO of claim 6, wherein the first PMOS transistor comprises a plurality of stacked PMOS transistors arranged in series.

17. The LDO of claim 4, wherein the first transistor is a high-voltage transistor such as a double-diffused metal-oxide-semiconductor (DMOS).

18. A voltage tracking circuit comprising:

a first transistor and a second transistor;

a first electronic circuit coupled to the first transistor; and a second electronic circuit coupled to the second transistor wherein:

the first electronic circuit is configured to generate a first current as a function of a gate-source voltage of the first transistor; and the second electronic circuit is configured to receive a second current being a mirror of the first current, thereby generating a voltage across a gate-source of the second transistor, the voltage being proportional to the gate-source voltage of the first transistor.

19. The voltage tracking circuit of claim 18, wherein the second electronic circuit is a replicated version of the first electronic circuit.

20. A method of stabilizing a feedback loop in a low dropout voltage regulator (LDO) comprising the steps of:

providing an input voltage to the LDO;

providing a load;

generating an output voltage and a load current, wherein a ratio of the output voltage to the input voltage has a transfer function;

varying a zero of the transfer function with the load current to track a pole of the transfer function, and adjusting the load current based on the output voltage, thereby regulating an output power.

* * * * *